US008807013B2

(12) United States Patent
Sohn

(10) Patent No.: US 8,807,013 B2
(45) Date of Patent: Aug. 19, 2014

(54) BOOM CYLINDER CONTROL CIRCUIT FOR CONSTRUCTION MACHINE

(75) Inventor: Won Sun Sohn, Seoul (KR)

(73) Assignee: Doosan Infracore Co., Ltd., Incheon (KR)

( * ) Notice: Subject to any disclaimer, the term of this patent is extended or adjusted under 35 U.S.C. 154(b) by 455 days.

(21) Appl. No.: 13/130,186

(22) PCT Filed: Nov. 2, 2009

(86) PCT No.: PCT/KR2009/006373
§ 371 (c)(1),
(2), (4) Date: May 19, 2011

(87) PCT Pub. No.: WO2010/058915
PCT Pub. Date: May 27, 2010

(65) Prior Publication Data

US 2011/0220231 A1 Sep. 15, 2011

(30) Foreign Application Priority Data

Nov. 19, 2008 (KR) ..... 10-2008-0115069

(51) Int. Cl.
*F15B 11/08* (2006.01)
*E02F 9/22* (2006.01)

(52) U.S. Cl.
CPC ..... *E02F 9/2207* (2013.01); *E02F 9/2296* (2013.01); *E02F 9/2292* (2013.01)
USPC ..... 91/437; 91/459; 91/464; 91/447

(58) Field of Classification Search
USPC ..... 137/596, 596.1, 596.12, 596.13, 137/596.14, 596.15, 596.16, 596.17, 596.2, 137/613; 91/437, 447, 454, 459, 461, 462, 91/527, 529, 450, 464, 436, 449; 60/421, 60/452, 467, 494
See application file for complete search history.

(56) References Cited

U.S. PATENT DOCUMENTS 3,768,371 A * 10/1973 Orme ..... 91/447
3,874,269 A * 4/1975 Walters ..... 137/625.64
(Continued)

FOREIGN PATENT DOCUMENTS

EP 0389136 9/1990
EP 0436740 7/1991
(Continued)

OTHER PUBLICATIONS

Search Report dated Apr. 30, 2010 for International Application No. PCT/KR2009/006373, filed Nov. 2, 2009.
Extended European Search Report dated Feb. 3, 2014 issued in European Application No. 09827680.1, 5 pages.

*Primary Examiner* — Craig Schneider
*Assistant Examiner* — Craig J Price
(74) *Attorney, Agent, or Firm* — John D. Veldhuis-Kroeze; Westman, Champlin & Koehler, P.A.

(57) ABSTRACT

Disclosed is a boom cylinder control circuit for a construction machine including a boom cylinder having an ascending-side chamber and a descending-side chamber. The boom cylinder control circuit includes: a first floating chamber with first and second input ports connected to the descending-side chamber and the ascending-side chamber, respectively, at one side, and first and second output ports connected with the drain tank, at the other side, and is switched to selectively connect the first and second input ports to the first and second output ports in accordance with an operational signal of the floating selection operation part; and a second floating valve of which one side is connected to the first output port and the other side is connected to the drain tank to selectively connect the first output port with the drain tank in accordance with the operational signal.

4 Claims, 5 Drawing Sheets

(56) References Cited

U.S. PATENT DOCUMENTS

| | | | | | |
|---|---|---|---|---|---|
| 3,878,763 | A | * | 4/1975 | Lang | 60/494 |
| 3,980,000 | A | * | 9/1976 | Iijima et al. | 137/596.14 |
| 4,083,291 | A | * | 4/1978 | Larsson | 91/450 |
| 4,184,410 | A | * | 1/1980 | Johnson | 137/596 |
| 4,194,362 | A | * | 3/1980 | Nonnenmacher | 60/494 |
| 4,640,095 | A | * | 2/1987 | Engel et al. | 137/596.17 |
| 4,736,673 | A | * | 4/1988 | Harada et al. | 91/527 |
| 6,092,454 | A | | 7/2000 | Vande Kerckhove | |

FOREIGN PATENT DOCUMENTS

| | | |
|---|---|---|
| JP | 08342485 | 6/1998 |
| KR | 20-1995-002072 | 3/1995 |
| KR | 10-0588285 | 8/2000 |
| KR | 20-0333340 | 3/2004 |
| KR | 10-2004-0097535 | 11/2004 |

* cited by examiner

BOOM CYLINDER CONTROL CIRCUIT FOR CONSTRUCTION MACHINE

CROSS-REFERENCE TO RELATED APPLICATIONS

This application is a Section 371 National Stage Application of International Application No. PCT/KR2009/006373, filed Nov. 2, 2009 and published, not in English, as WO2010/058915 on May 27, 2010.

FIELD OF THE DISCLOSURE

The present disclosure relates to a construction machine, such as excavator, particularly a boom cylinder control circuit for a construction machine which controls a boom cylinder that lifts a boom.

BACKGROUND OF THE DISCLOSURE

In general, construction machines, such as excavator, usually perform leveling that makes the ground even while moving forward/backward a bucket. The worker should minutely control the boom and the bucket to keep the load, which is applied to the ground by the bucket, uniform in the leveling. Therefore, the worker necessarily feels very tired in the leveling. Further, when the boom is not minutely controlled in the leveling, the force of the bucket applied to the ground is too large such that the bucket cuts into the ground, or the force of the bucket applied to the ground is too small, whereby the leveling is not performed well.

Meanwhile, the bucket is sometimes replaced by an optional device, such as a breaker, in the construction machines. The breaker is an optional device that breaks rocks and is required to always apply predetermined force to the objects to break, such as rocks. However, in the breaker, a reaction that the boom rebounds up occurs when the breaker breaks the objects. Therefore, the worker needs to more minutely control the boom and the breaker.

Recently, a research that makes the bucket apply predetermined force to the objects, such as the ground or rocks, by using the weight of the boom is conducted, in order to remove the problem described above. In particular, since the phenomenon that the boom rebounds up when the breaker operates occurs, it is required to consider the characteristics of the work even if the weight of the boom is used.

The discussion above is merely provided for general background information and is not intended to be used as an aid in determining the scope of the claimed subject matter.

SUMMARY

The present disclosure has been made in an effort to provide a boom cylinder control circuit for a construction machine which can efficiently use the weight of a boom, depending on the characteristics of work, and considerably improve convenience in the work.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

An exemplary embodiment of the present disclosure provides a boom cylinder control circuit for a construction machine that includes a boom cylinder 1 having an ascending-side chamber 1*a* and a descending-side chamber 1*b*, the boom cylinder control circuit including: a first floating valve 30 that selectively connects and disconnects the descending-side chamber 1*b* and the ascending-side chamber 1*a* of the boom cylinder 1 with or from a drain tank T; a second floating valve 40 that is additionally disposed in a channel between the drain tank T and the descending-side chamber 1*b* connected with the drain tank T through the first floating chamber 30, and selectively connects and disconnects the descending-side chamber 1*b* and the drain tank T; and un-floating operation parts 20 and 120 that provide operational signals such that the first floating valve 30 and the second floating valve 40 are switched to be opened or closed.

In more detail, the first floating chamber 30 has first and second input ports 31 and 32 connected to the descending-side chamber 1*b* and the ascending-side chamber 1*a* of boom cylinder 1, respectively, at one side, and a first output port 33 and a second output port 34 connected with the drain tank T, at the other side, and the second floating valve 40 is connected to the first output port 33 of the first floating valve 30, at one side, and connected to the drain tank T, at the other side.

The boom cylinder control circuit for a construction machine according to the exemplary embodiment of the present disclosure further includes: a floating selection valve 50 selectively switched to first and second spool positions in accordance with an operational signal of the un-floating operation parts 20 and 120, where in the first spool position 51 a boom-down signal line 3*b* of a boom operation part 3 is connected with a pressure receiving portion 35 of the first floating valve 30 and a descending pressure receiving portion 4*b* of a boom control valve 4 is connected with the drain tank T, and in the second spool position 52 the boom-down signal line 3*b* of boom operation part 3 is connected with the descending pressure receiving portion 4*b* of boom control valve 4 and the pressure receiving portion 35 of first floating valve 30 is connected to the drain tank T, such that when the boom-down signal line 3*b* is connected to the pressure receiving portion 35 of first floating valve 30 and a boom-down pressure signal is supplied to the pressure receiving portion 35 of the first floating valve 30 through the boom-down signal line 3*b*, the first floating valve 30 is switched such that the first and second input ports 31 and 32 are connected to the first and second output ports 33 and 34, respectively.

The boom cylinder control circuit for a construction machine further includes floating selection operation parts 10 and 110 that supply a signal for switching the floating selection valve 50 to the first spool position 51 or the second spool position 52 in priority to signals of the un-floating operation parts 20 and 120, in which when an un-floating signal is generated by the floating selection operation parts 10 and 110, the floating selection valve 50 is switched to the second spool position 52, such that the boom-down signal line 3*b* is connected to a descending pressure receiving portion 4*b* of the boom control valve 4 and a pressure receiving portion 35 of the first floating valve 30 is connected to the drain tank T.

When the floating selection operation parts 10 and 110 generate floating return signals, the floating selection valve 50 is switched to the first spool position 51, such that the boom-down signal line 3*b* is connected to the pressure receiving portion 35 of the first floating valve 30 and the descending pressure receiving portion 4*b* of the boom control valve 4 is connected to the drain tank T.

The floating selection operation part 110 according to another exemplary embodiment of the present disclosure includes: a first switch 111 that outputs a signal for switching floating selection valve 50; and a second switch 112 that outputs a signal for switching the second floating valve 40, in which the un-floating operation part 120 selectively blocks a signal from the first switch 111 to floating selection valve 50.

According to the exemplary embodiments of the present disclosure, since a one-way floating function and a two-way floating function can be implemented through a simple operation by the first floating valve and the second floating valve, not only work efficiency is improved, but convenience for a worker is improved. In particular, since the first floating valve and the second floating valve are connected in series, it is possible to prevent an unnecessary floating function (for example, when only the descending-side chamber of the boom cylinder is floated) from being selected and it is possible to easily implement a control logic for floating selection.

Further, it is possible to prevent a safety accident, such as rapid fall of the boom, simultaneously with selection of the floating function, by switching the first floating valve by using the signal pressure of the boom-down signal line.

Furthermore, when it temporarily needs heavy work which requires heavier loads than the weight of the boom, such as the work of hardening the ground during progressing the work of making the ground even, it is possible to temporarily release the floating modes once the floating selection valve is switched by operating un-floating operation part, such that efficiency in work is considerably improved. Further, it is possible to return to the floating mode which was selected just before un-floating by operating the un-floating operation part, so that operational convenience is further improved.

DETAILED DESCRIPTION

Figure 1:
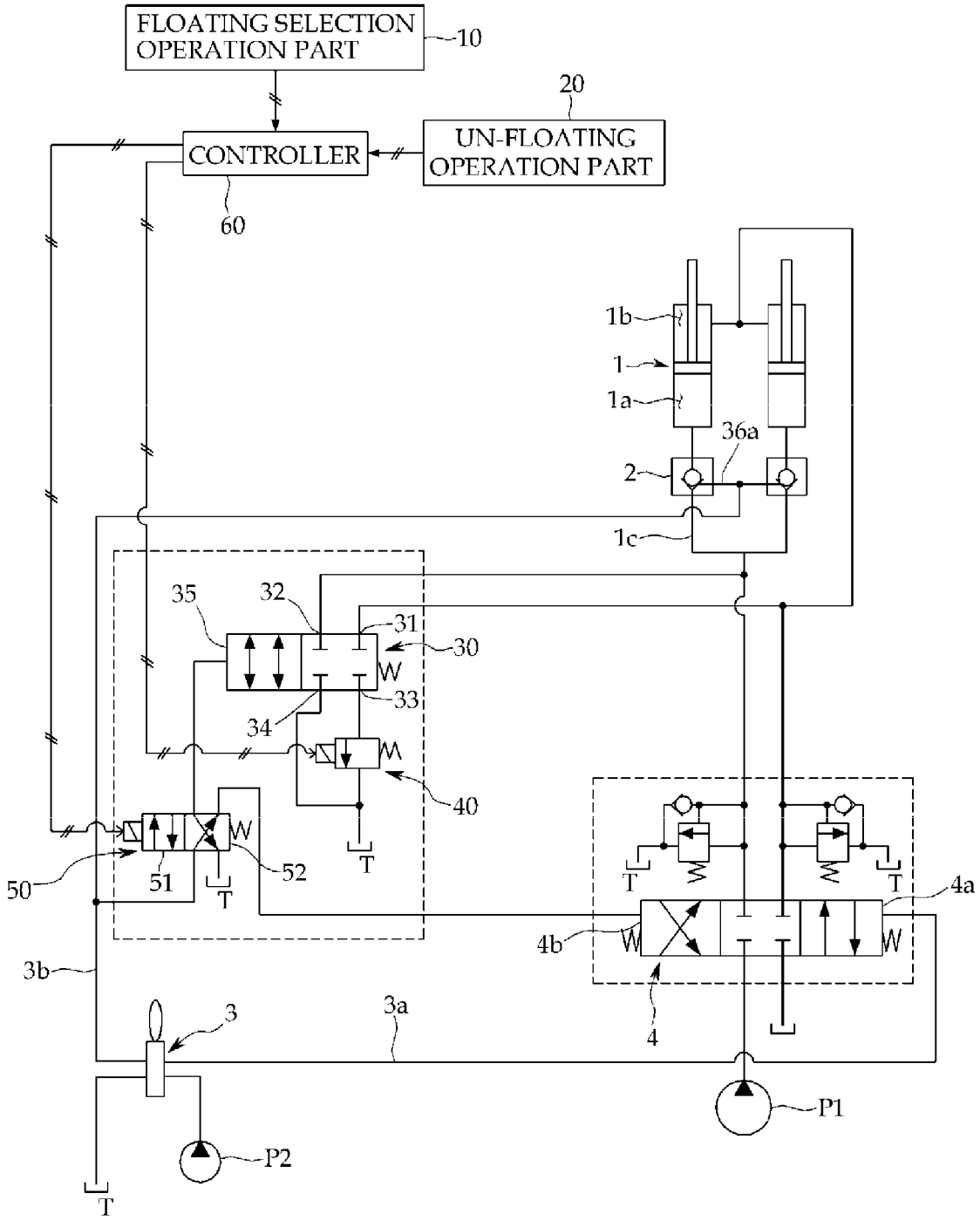
FIG. 1 is a view schematically showing a boom cylinder control circuit according to an exemplary embodiment of the present disclosure.

<Explanation of Main Reference Numerals and Symbols>

| | |
|---|---|
| 10: Floating selection operation part | 20: Un-floating operation part |
| 30: First floating valve | 31, 32: First and second input ports |
| 33, 34: First and second output ports | 40: Second floating valve |
| 50: Floating selection valve | |

Hereinafter, a boom cylinder control circuit for a construction machine according to an exemplary embodiment of the present disclosure is described in detail.

Referring to FIG. 1, a boom cylinder control circuit for a construction machine according to an exemplary embodiment of the present disclosure has been designed to efficiently control a so-called floating state that selectively connects a drain tank T with an ascending-side chamber 1*a* and a descending-side chamber 1*b* of a boom cylinder 1, depending on characteristics of work. In particular, the boom cylinder control circuit according to the exemplary embodiment of the present disclosure can efficiently implement both a two-way floating mode where the ascending-side chamber 1*a* and the descending-side chamber 1*b* can be floated and a one-way floating mode where only the ascending-side chamber 1*a* of boom cylinder 1 can be floated. The boom cylinder control circuit for a construction machine includes a floating selection operation part 10, a first floating valve 30, a second floating valve 40, a floating selection valve 50, a controller 60, and an un-floating operation part 20, in order to implement the function described above.

Floating selection operation part 10 is provided to select any one of a normal work mode for normal work not implementing the floating function, a one-way floating mode, and a two-way floating mode. Floating selection operation part 10 may be implemented by a three-position button.

First floating valve 30 is provided to selectively connect drain tank T with ascending-side chamber 1*a* and descending-side chamber 1*b* of boom cylinder 1, in which in the initial state the first floating valve 30 blocks ascending-side chamber 1*a* and descending-side chamber 1*b* of boom cylinder 1. Once any one of the one-way floating mode and the two-way floating mode is selected by floating selection operation part 10, the first floating valve 30 is switched such that ascending-side chamber 1*a* and descending-side chamber 1*b* of boom cylinder 1 communicates with drain tank T.

In more detail, first floating valve 30 has first and second input ports 31 and 32 at a side and first and second output ports 33 and 34 at the other side. First input port 31 is connected to descending-side chamber 1*b* of boom cylinder 1 and second input port 32 is connected to ascending-side chamber 1*a* of boom cylinder 1. Meanwhile, first output port 33 is connected to a second floating valve 40 that is described below and second output port 34 is connected to drain tank T.

Therefore, when first floating valve 30 is switched to the initial state shown in FIG. 1, ascending-side chamber 1*a* and descending-side chamber 1*b* of boom cylinder 1 are closed. When boom operation part 3 is operated in this state, pilot signal pressure generated from boom operation part 3 is applied to pressure receiving portions 4*a* and 4*b* of boom control valve 4 and boom control valve 4 is switched in response to the applied signal pressure. Accordingly, operational oil discharged from a main pump P1 changes the flow direction by boom control valve 4 and supplied to ascending-side chamber 1*a* or descending-side chamber 1*b* of boom cylinder 1. Accordingly, boom cylinder 1 ascends or descends.

Figure 2:
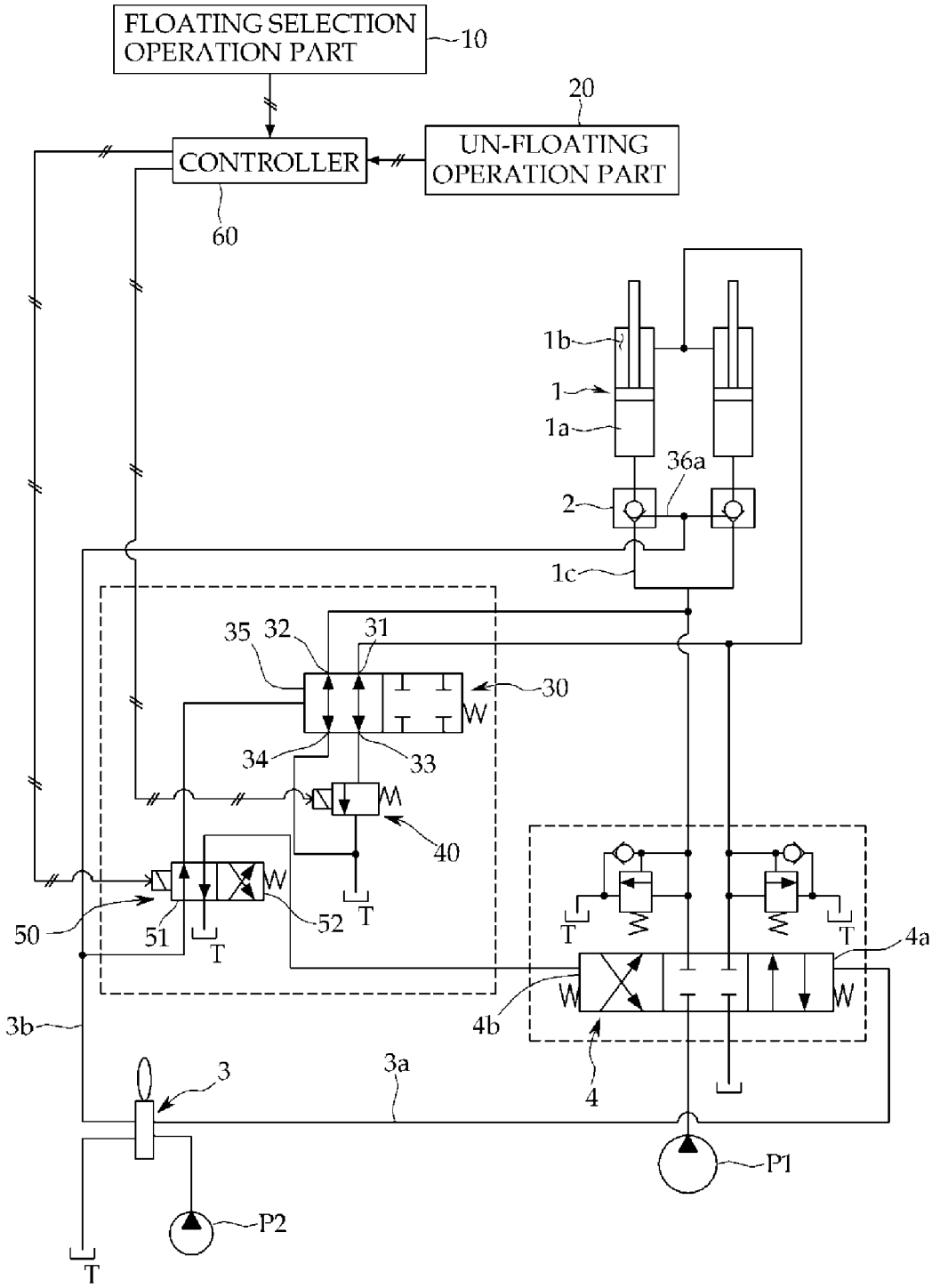
FIG. 2 is a view schematically showing when a one-way floating mode is selected in the boom cylinder control circuit of FIG. 1.
Figure 3:
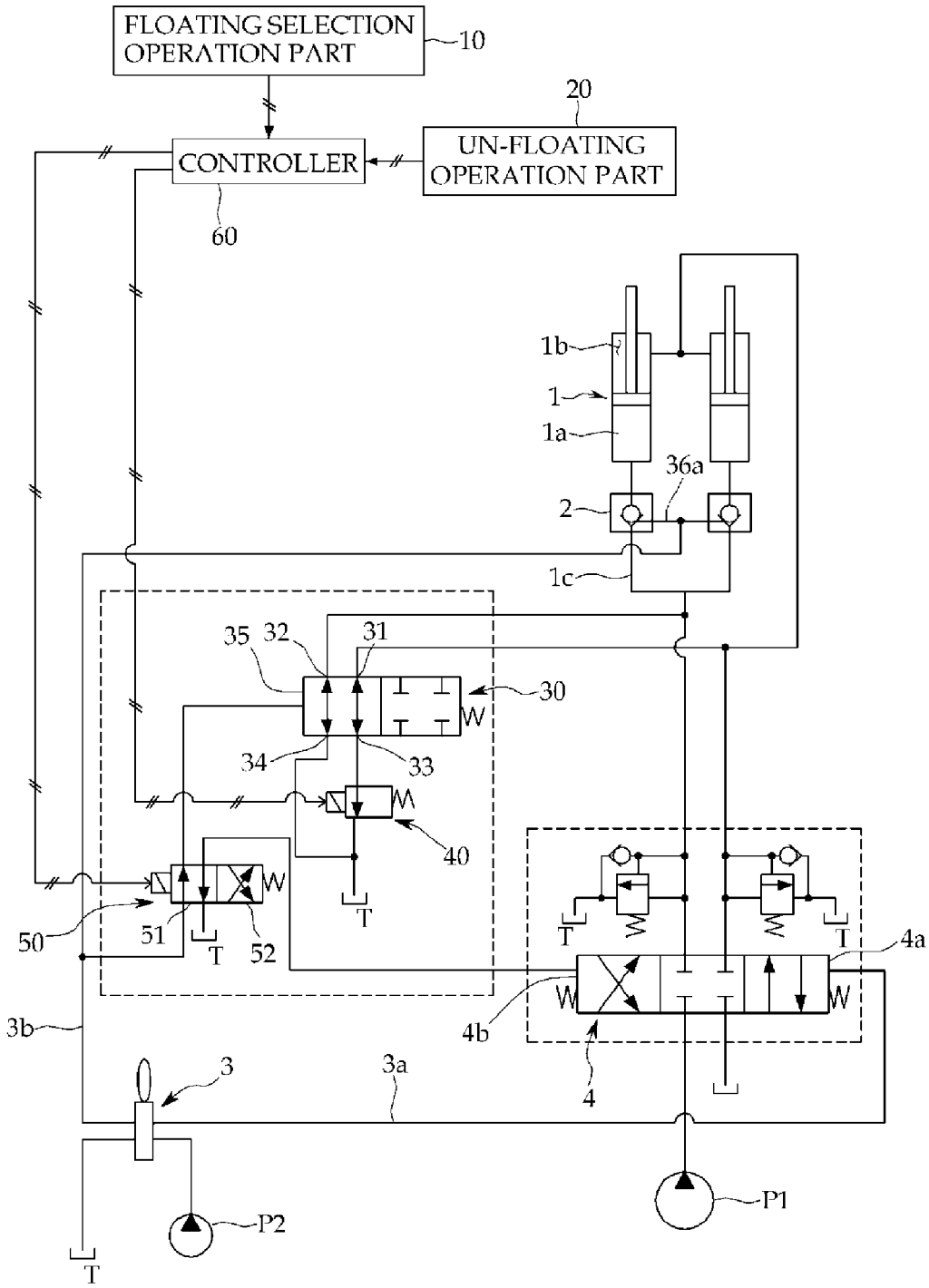
FIG. 3 is a view schematically showing when a two-way floating mode is selected in the boom cylinder control circuit of FIG. 1.

Further, as the signal pressure is inputted to pressure receiving portion 35 of first floating valve 30 and it is switched, as shown in FIGS. 2 and 3, first and second input ports 31 and 32 communicate with first and second output ports 33 and 34, respectively. Therefore, descending-side chamber 1*b* of boom cylinder 1 is connected to second floating valve 40 through first input port 31 and first output port 33. In this state, descending-side chamber 1*b* of boom cylinder 1 selectively communicates with drain tank T, in accordance with the switched state of second floating valve 40. Further, ascending-side chamber 1*a* of boom cylinder 1 communicates with drain tank T through second input port 32 and second output port 34. Therefore, the boom keeps descending by the weight of the boom, such that the bucket applies predetermined force to the ground by the weight of the boom.

Although it is exemplified in the exemplary embodiment that first floating valve 30 has pressure receiving portion 35, first floating valve 30 may be implemented as a solenoid type that can be applied by an electric signal. In this case, floating selection valve 50 that is described below is removed.

Second floating valve 40 is a floating mode selection valve for selecting any one of the one-way floating mode and the two-way floating mode, and as described above, one side is connected to first output port 33 and the other side is connected to drain tank T. Therefore, with first floating valve 30 switched to be open, as shown in FIGS. 2 and 3, when second floating valve 40 is switched to be closed, as shown in FIGS. 1 and 2, the one-way floating mode is selected. That is, as shown in FIG. 2, when first floating valve 30 is switched to be open and second floating valve 40 is switched to be closed, ascending-side chamber 1*a* of boom cylinder 1 is connected to drain tank T, while descending-side chamber 1*b* of boom cylinder 1 is disconnected from drain tank T. Therefore, boom cylinder 1 can be compressed, but cannot extend, such that the boom can freely descend, but cannot ascend. Therefore, the bucket can apply predetermined load to the ground by the weight of the boom, whereas the boom does not ascend even if shock is applied to the bucket such that the boom ascends by an obstacle, such as the ground or rocks. This state may be defined as the one-way floating mode and this is useful when using a breaker as the optional devices. That is, when the breaker is used, it is possible to apply predetermined shock to the object to break, such as rocks, by the weight of the boom, but the boom is prevented from moving up by shock, such that it is possible to perform work using the breaker.

Meanwhile, when both first and second floating valves 30 and 40 are opened, ascending-side chamber 1*a* and descending-side chamber 1*b* of boom cylinder 1 are both connected to drain tank T, such that the two-way floating mode is implemented, as described above. The two-way floating mode is a state in which boom cylinder 1 can be freely moved up and down by external force, which is useful in making the ground even by using the bucket. That is, the bucket should apply predetermined force to the ground by the weight of the boom and the boom should freely ascend and descend while the bucket moves forward and backward, in order to make the ground even.

Second floating valve 40 is switched to be opened or closed in response to a signal of floating selection operation part 10.

Floating selection valve 50 is provided to selectively apply signal pressure to pressure receiving portion 35 of first floating valve 30, and particularly, it switches first floating valve 30 to be opened only when a boom-down signal is generated by boom operation part 3.

In more detail, floating selection valve 50 is connected, at one side, with both pressure receiving portion 35 of first floating valve 30 and a descending pressure receiving portion 4*b* of boom control valve 4, and also connected, at the other side, with both a boom-down signal line 3*b* of boom operation part 3 and drain tank T. Further, in the initial state, floating selection valve 50, as shown in FIG. 1, connects a boom-down signal line 3*b* to descending pressure receiving portion 4*b* of boom control valve 4 and connects pressure receiving portion 35 of first floating valve 30 to drain tank T, that is, at a second spool position 52. This state is a normal work mode with the floating mode not selected. Therefore, as boom operation part 3 is operated, signal pressure is applied to boom control valve 4 through boom-down signal line 3*b* or boom-up signal line 3*a*, and as boom control valve 4 is switched, boom cylinder 1 extends or contracts, such that the boom ascends or descends.

On the contrary, when floating selection valve 50 is switched to one side, that is, to a first spool position 51, as shown in FIGS. 2 and 3, boom-up signal line 3*a* is connected to ascending pressure receiving portion 4*a* of boom control valve 4, while boom-down signal line 3*b* is connected to pressure receiving portion 35 of first floating valve 30. Therefore, high pressure is generated in boom-down signal line 3*b* and high signal pressure is generated in pressure receiving portion 35 of first floating valve 30 by operating boom operation part 3, such that first floating valve 30 is switched to be opened, as shown in FIGS. 2 and 3.

Floating selection valve 50 is switched by a signal generated from floating selection operation part 10.

Controller 60 is provided to apply an electric signal to second floating valve 40 and floating selection valve 50 in response to the signal generated from floating selection operation part 10. In more detail, when the normal work mode is selected by floating selection operation part 10, controller 60 does not supply current to second floating valve 40 and floating selection valve 50. Therefore, second floating valve 40 and floating selection valve 50 are kept in the initial state shown in FIG. 1. In this state, since floating selection valve 50 is in the initial state, pressure receiving portion 35 of first floating valve 30 is kept connected with drain tank T, that is, in the initial state.

On the contrary, when the one-way floating mode (also called a 'breaker mode' because it is useful for breaker work) is selected by floating selection operation part 10, the electric signal is supplied to floating selection valve 50, but the electric signal is not supplied to second floating valve 40. Therefore, floating selection valve 50 and second floating valve 40 are switched to the state shown in FIG. 2. If boom operation part 3 does not perform the boom-down operation, first floating valve 30 is closed, as shown in FIG. 1. This is for preventing a safety accident of the boom falling down without preparation as soon as floating selection operation part 10 is operated. Meanwhile, the pressure of the operation oil that is discharged from a pilot pump P2, when the worker operates boom operation part 3 for moving downward the boom, is applied to pressure receiving portion 35 of first floating valve 30, such that first floating valve 30 is switched to the state shown in FIG. 2. Therefore, ascending-side chamber 1*a* of boom cylinder 1 becomes connected to drain tank T, such that the boom falls due to the weight of the boom. In this state, the worker can control the fall speed of the boom due to the weight by using boom operation part 3. That is, it is possible to control the degree of opening of first floating valve 30 by reducing the amount of operation of boom operation part 3, such that it is possible to control the amount of the operation oil of ascending-side chamber 1*a* of boom cylinder 1 that is drained to drain tank T. That is, it is possible to control the descending speed of the boom. As described above, first floating valve 30 is switched by the signal pressure of boom-down signal line 3*b*, such that it is possible to prevent a safety accident of the boom quickly falling down.

Meanwhile, when high pressure is generated in boom-down signal line 3*b* by operating boom operation part 3, the pressure of boom-down signal line 3*b* is applied to a boom holding valve 2 installed in a hydraulic line 1*c* of ascending-side chamber 1*a* of boom cylinder 1 through an un-holding signal line 36*a*. Accordingly, boom holding valve 2 is opened and the operation oil of ascending-side chamber 1*a* of boom cylinder 1 can be drained.

Un-floating operation part 20 is provided to temporarily remove the floating mode, and when an un-floating signal is generated by un-floating operation part 20, controller 60 returns floating selection valve 50 to the initial state shown in FIG. 1. Obviously, the function described above can be implemented by operating floating selection operation part 10. However, when the floating mode is canceled by operating floating selection operation part 10, it is inconvenient to return to the present floating mode. That is, the floating mode can be canceled when floating selection operation part 10 is operated by worker though the equipment is working in the floating mode. In this state, if the worker wants to return to the one-way floating mode, it is required to select again the one-way floating mode by operating floating selection operation part 10 in order to perform the work in the one-way floating mode. However, the worker may carelessly select the two-way floating mode instead of one-way floating mode by operating floating selection operation part 10 or when the worker cannot remember the previous floating mode. When the breaker work is performed in this state, the boom may be moved by reaction of the breaker work, regardless of the operator's intention, such that a safety accident may occur or the working efficiency may be reduced. However, un-floating is performed through un-floating operation part 20, it returns to the previous floating mode. This is because the signal generated by un-floating operation part 20 changes only floating selection valve 50. The un-floating signal by un-floating operation part 20 is applied to floating selection valve 50 in priority to the signal of floating selection operation part 10. Un-floating operation part 20, though not shown, may be implemented as a joystick type, or a push button type on the top of a boom operation joystick such that the operator can easily perform un-floating while operating the boom.

Hereafter, the operational process of the boom cylinder control circuit for a construction machine having the configuration described above is described in detail.

First, FIG. 1 shows a normal work mode state. Referring to FIG. 1, first and second floating valves 30 and 40 and floating selection valve 50 have been switched to the initial state. Therefore, as boom operation part 3 is operated, the signal pressure is applied to pressure receiving portions 4*a* and 4*b* of boom control valve 4 through boom-down signal line 3*b* and boom-up signal line 3*a*, and as boom control valve 4 is switched to the left or right of FIG. 1 in response to the signal of boom operation part 3, the operation oil is supplied to ascending-side chamber 1*a* or descending-side chamber 1*b* of boom cylinder 1, such that the boom makes ascending or descending motion.

In this state, when the one-way floating mode is selected through floating selection operation part 10, controller 60 switches first floating valve 30 and floating selection valve 50 by supplying a signal to floating selection valve 50, as shown in FIG. 2. Accordingly, boom-down signal line 3*b* is connected with pressure receiving portion 35 of first floating valve 30. In this state, when a boom-down signal is generated through boom operation part 3, the operation oil of pilot pump P2 is supplied to pressure receiving portion 35 of first floating valve 30 through boom-down signal line 3*b* and boom holding valve 2 is opened. Accordingly, first floating valve 30 is switched, as shown in FIG. 2, and ascending-side chamber 1*a* of boom cylinder 1 is connected to drain tank T. Meanwhile, descending-side chamber 1*b* of boom cylinder 1 is closed. This state is a mode useful for the breaker work, in which it is possible to prevent the boom from being moved up by reaction while the breaker applies predetermined force to the object, such as rocks, such that it is possible to efficiently perform the breaker work.

Meanwhile, when the two-way floating mode is selected through floating selection operation part 10, controller 60 applies a signal to second floating valve 40 and floating selection valve 50. Therefore, second floating valve 40 and floating selection valve 50 are switched, as shown in FIG. 3. Accordingly, boom-down signal line 3*b* is connected to pressure receiving portion 35 of first floating valve 30 and first output port 33 of first floating valve 30 is connected to drain tank T. In this state, when a boom-down signal is generated through boom operation part 3, the operation oil of pilot pump P2 is supplied to pressure receiving portion 35 of first floating valve 30, such that first floating valve 30 is switched to be open, as shown FIG. 3, and boom holding valve 2 is switched to be open. Accordingly, ascending-side chamber 1*a* and descending-side chamber 1*b* of boom cylinder 1 are both connected with drain tank T. This state is a mode useful to work for making the ground even, in which not only it is possible to apply predetermined force to the ground by the weight of the boom while moving the bucket forward/backward when making the ground even, but up/down movement of the boom by operation of the bucket and the arm is free, such that convenience for the worker in operation is considerably improved.

Figure 4:
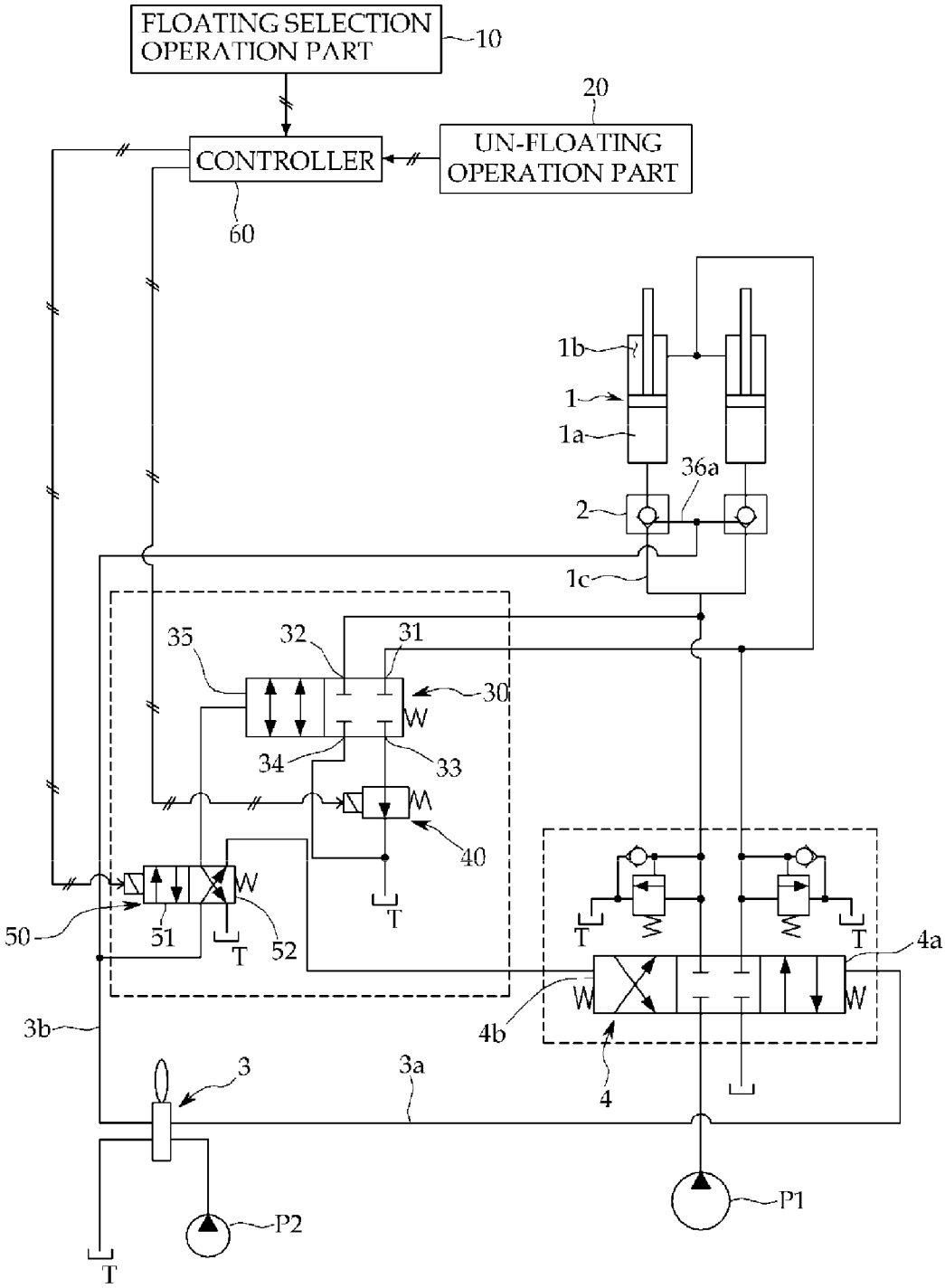
FIG. 4 is a view schematically showing when a floating function is removed by an un-floating operation part in the state of FIG. 3.

Meanwhile, the worker needs to apply load over the weight of the boom on the ground, in work of hardening the ground in the work of making the ground even. In this case, the worker can temporarily remove the floating mode through un-floating operation part 20. When the worker generates an un-floating signal through the un-floating operation part 20, controller 60 returns floating selection valve 50 to the initial state, as shown in FIG. 4. Accordingly, boom-down signal line 3*b* and boom-up signal line 3*a* are connected again to pressure receiving portions 4*a* and 4*b* of boom control valve 4, respectively, such that the boom can be normally moved up. After the work, such as hardening, is finished, the worker generates a floating signal again through un-floating operation part 20. Accordingly, controller 60 switches again floating selection valve 50 to the state shown in FIG. 3, such that the two-way floating function can be performed. As described above, the floating function can be temporarily removed by un-floating operation part 20 and the floating function that is previously performed is performed when the function returns to the floating function, such that operational convenience for the worker and operational efficiency can be further improved.

Figure 5:
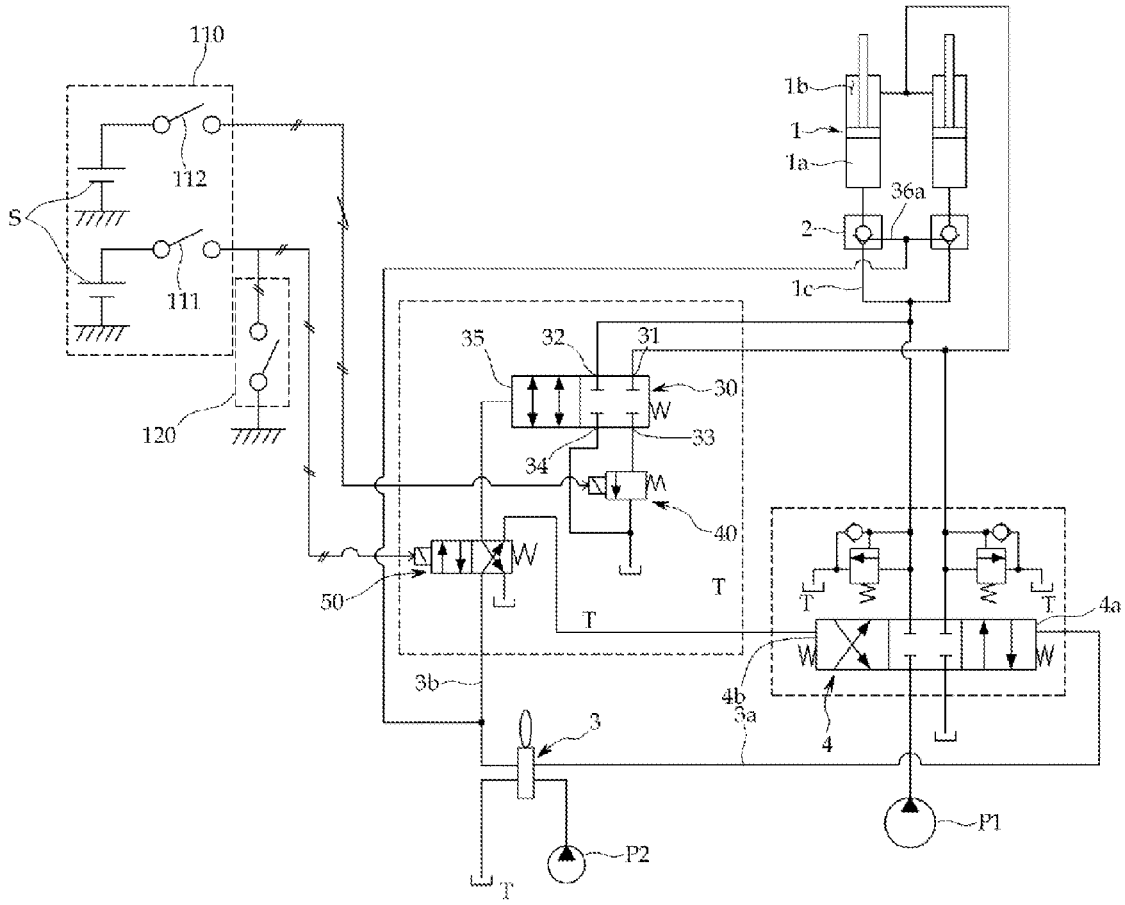
FIG. 5 is a view schematically showing a boom cylinder control circuit according to another exemplary embodiment of the present disclosure.

FIG. 5 is a view schematically showing a boom cylinder control circuit according to another exemplary embodiment of the present disclosure.

The exemplary embodiment of the present disclosure is implemented such that signals of floating selection operation part 110 and un-floating operation part 120 are directly supplied to second floating valve 40 and floating selection valve 50. The other configurations are the same and given with the same reference numerals.

Floating selection operation part 10 includes first and second switches 111 and 112. First switch 111 is provided to selectively supply current to floating selection valve 50 and of which one side is electrically connected to a power source S and the other side is electrically connected to a signal supplier of floating selection valve 50. Accordingly, when first switch 111 is turned on (ON), floating selection valve 50 is switched to the right side in FIG. 5 and boom-down signal line 3*b* is connected to pressure receiving portion 35 of first floating valve 30.

Second switch 112 is provided to selectively supply electric signal to second floating valve 40 and of which one side is electrically connected to a power source S and the other side is electrically connected to a signal supplier of second floating valve 40. Accordingly, when second switch 112 is turned on (ON), second floating valve 40 is switched to be open, that is, to the right in FIG. 5.

As a result, when both of first and second switches 111 and 112 are turned off (OFF), as shown in FIG. 5, the normal work mode with the floating function not selected is implemented, as shown in FIG. 5. On the contrary, when first switch 111 is turned on (ON) and second switch 112 is turned off (OFF), the one-way floating mode is selected. Further, both first and second switches 111 and 112 are turned on (ON), the two-way floating mode is selected.

Un-floating operation part 20 is provided to temporarily remove the floating mode by selectively blocking the signal supplied from first switch 111 to floating selection valve 50, of which one side is grounded and the other side is connected to first switch 111 and a signal line of floating selection valve 50. According to this configuration, when un-floating operation part 120 is turned on (ON), electric signal is not supplied to floating selection valve 50 even if first switch 111 is turned on (ON), such that floating selection valve 50 becomes the initial state, that is, the state with the floating function not selected. In this state, when un-floating operation part 120 is turned off (OFF) again, the signal of first switch 111 is supplied to floating selection valve 50 and the mode can return to the original floating mode.

As described above, since it is possible to simply implement floating selection operation part 110 and un-floating operation part 120 with only switches, it is possible to simplify the structure of the equipment and reduce the manufacturing cost.

Although the present invention has been described with reference to preferred embodiments, workers skilled in the art will recognize that changes may be made in form and detail without departing from the spirit and scope of the invention.

The invention claimed is:

1. A boom cylinder control circuit for a construction machine that includes a boom cylinder having an ascending-side chamber and a descending-side chamber, the boom cylinder control circuit comprising:

a boom control valve that supplies operational oil discharged from a main pump to the ascending-side chamber and the descending-side chamber of the boom cylinder so that the boom cylinder ascends or descends;

a first floating valve that selectively connects a drain tank with the descending-side chamber and the ascending-side chamber of the boom cylinder;

a second floating valve additionally disposed on an oil flow line, which connects the drain tank with the descending-side chamber through the first floating valve, the second floating valve selectively connecting the descending-side chamber with the drain tank; and a floating selection operation part that provides an operational signal such that the first floating valve and the second floating valve are switched to be opened or closed and, a floating selection valve that is selectively switched to a first spool position or a second spool position in accordance with the operational signal of the floating selection operation part, wherein in the first spool position a boom-down signal line of a boom operation part is connected with a pressure receiving portion of the first floating valve and a descending pressure receiving portion of the boom control valve is connected with the drain tank, and wherein in the second spool position the boom-down signal line of the boom operation part is connected with the descending pressure receiving portion of the boom control valve and the pressure receiving portion of the first floating valve is connected with the drain tank.

2. The boom cylinder control circuit for a construction machine of claim 1, wherein the first floating valve has at one side first and second input ports respectively connected to the descending-side chamber and the ascending-side chamber of the boom cylinder, and at the other side a first output port connected with the second floating valve and a second output port connected with the drain tank, and wherein the second floating valve is connected at one side to the first output port of the first floating valve, and at the other side to the drain tank.

3. The boom cylinder control circuit for a construction machine of claim 1, further comprising:

a un-floating operation part that provides a signal for selectively switching the floating selection valve to the first spool position or the second spool position overriding the operational signal of the floating selection operation part.

4. The boom cylinder control circuit for a construction machine of claim 3, wherein the floating selection operation part includes:

a first switch that outputs a signal for switching the floating selection valve; and a second switch that outputs a signal for switching the second floating valve, wherein the un-floating operation part selectively blocks the signal from the first switch to the floating selection valve.

* * * * *